US006182840B1

(12) United States Patent
Tegel

(10) Patent No.: US 6,182,840 B1
(45) Date of Patent: Feb. 6, 2001

(54) DEVICE FOR THE SECURE DISPLAY OF ARTICLES

(75) Inventor: Omar Tegel, Heiloo (NL)

(73) Assignee: Top Vision Group B.V., BP Haarlem (NL)

( * ) Notice: Under 35 U.S.C. 154(b), the term of this patent shall be extended for 0 days.

(21) Appl. No.: 09/254,711

(22) PCT Filed: Sep. 12, 1997

(86) PCT No.: PCT/NL97/00519

§ 371 Date: Mar. 12, 1999

§ 102(e) Date: Mar. 12, 1999

(87) PCT Pub. No.: WO98/10685

PCT Pub. Date: Mar. 19, 1998

(30) Foreign Application Priority Data

Sep. 12, 1996 (NL) ..... 1004019

(51) Int. Cl.[7] ..... A47F 7/02
(52) U.S. Cl. ..... 211/85.1
(58) Field of Search ..... 211/85.1, 4; 248/902

(56) References Cited

U.S. PATENT DOCUMENTS 4,805,781 * 2/1989 Tegel ..... 211/85.1
4,930,740 * 6/1990 Vogt ..... 211/85.1
5,178,283 * 1/1993 Ennis ..... 211/85.1
5,559,567 * 9/1996 Kolton et al. ..... 248/902
5,864,924 * 2/1999 Rodriguez ..... 248/902

FOREIGN PATENT DOCUMENTS 246 702 11/1987 (EP) .
2 648 030 12/1990 (FR) .

* cited by examiner

*Primary Examiner*—Alvin Chin-Shue
*Assistant Examiner*—Sarah Purol
(74) *Attorney, Agent, or Firm*—Sughrue, Mion, Zinn, Macpeak & Seas, PLLC

(57) ABSTRACT

Device for the secure display of a number of articles positioned alongside or above one another. This device consists of a support to which a number of pin-shaped projections are rigidly attached. A number of hook-shaped projections are fitted such that they are movable relative to said pin-shaped projections and together with said projections are able to delimit a retainer. These hook-shaped projections can be operated together with the aid of motor means. It is proposed that the motor means are not constructed such that they are rigidly connected to the operating rod for these hook-shaped projections but to have only the opening stroke of the operating rod performed by the motor means. Closing consequently takes place by the weight, optionally assisted by a spring. In the closed position, locking is provided which optionally can be operated by the motor means.

8 Claims, 3 Drawing Sheets

DEVICE FOR THE SECURE DISPLAY OF ARTICLES

BACKGROUND OF THE INVENTION

The present invention relates to a device for the secure display of a number of articles placed alongside and/or above one another, comprising a support provided with a number of first projections rigidly attached thereto and an equal number of second projections arranged such that they are movable with respect to said first projections, a first and a second projection always delimiting, in the position in which they are brought together, optionally in combination with said support, a retainer for accommodating said article to be displayed, with the second projection arranged above the first projection, said movable projections being connected to one another via an operating rod which is linked to motor means in order to drive said second projections away from said first projections in order to release the retainer.

A device of this type is disclosed in EP-A 0 246 702 in the name of C. J. Tegel. This publication provides a solution to the problem which arises in shops where, for example, spectacles are sold. On the one hand, the frames must be readily accessible to potential customers who, after all, will want to try on a number of such frames before deciding to purchase a specific frame. On the other hand, however, it is necessary to prevent such frames being stolen. To this end operation with motor means is proposed. The optician or other sales person is able, for example, with the aid of a remote control to release the retainer in which part of the frame is locked if he or she sees that a potential purchaser wishes to try on the frame concerned. By releasing, access is given to a number of frames in one operation, so that said purchaser can try on a number of frames.

After the interested consumer has left the shop, the sales person can restore the device to the secured position. It is, of course, possible also to carry this out automatically after a period of time has elapsed.

However, it has been found that on closing there is a possible risk of painful trapping of a part of the body of the potential customer, or that the frame is damaged if this has been positioned incorrectly. After all, the projections move towards one another.

SUMMARY OF THE INVENTION

This means that the aim of the present invention is to provide a device with which it is possible to release the retainer delimited between the projections, and optionally the support, with the aid of the motor means and then close said retainer again, but prevent said closure if there is a risk of pinching, such as when fingers or other parts of the body are placed between the projections.

This aim is realised with a device as described above in that the movement of the operating rod can be disconnected from the movement of the motor means when said first and second projections move towards one another if a predetermined force on said operating rod is exceeded, and wherein locking means are provided for locking said first and second projections in the position in which they have been brought together.

The opening movement is carried out by the motor means because the risk of injury does not exist or exists to a lesser extent during this movement. Because in practice there is an appreciable distance between the top of the operated projections and the underside of the stationary projections, a motor with appreciable power can be used for opening. Closing takes place by gravity, optionally assisted by springs or the like. As a result the closing force can be determined very accurately and can be chosen to be so low that injury cannot occur. Locking then takes place at the end of the closing stroke, so that if closing has taken place under normal conditions opening is no longer possible without unlocking.

It is pointed out that French Patent 2 648 030 discloses a storage device for spectacle frames, wherein two projections are moved relative to one another. This movement is achieved by engagement of a ridge on a plate, which plate is joined to one of the projections. With this arrangement the closing movement takes place by driving an operating rod upwards in a forcible manner, that is to say if any parts come between the projections during this closing movement said parts will be pinched. Release takes place by gravity, which is precisely the converse of the method in the present application.

According to an advantageous embodiment of the invention, such engagement is realised in only one direction, that is to say the opening direction, in that the motor is provided with an abutment element which during opening comes into contact with the contact surface of the operating rod. Such a contact can be removed during the withdrawal movement if an article, such as a part of the body, is inserted.

The locking means can be any construction known from the prior art. Preferably, however, said locking means consist of a locking lip which can be made to engage with a raised part provided on the operating rod, which locking lip can preferably be operated by the motor means. As a result it is not necessary to fit a separate control unit for the locking means.

These motor means can comprise any construction known from the prior art, such as coils, hydraulic and/or pneumatic constructions. According to an advantageous embodiment, however, said motor means consist of a rotary motor provided with a connecting rod mechanism, it being possible to bring the free end of the connecting rod into contact with the contact surface of the operating rod. A relatively large force can be transmitted in this way. A relatively appreciable force is important if a number of the devices described above have been brought together to form an assembly. The devices are preferably operated by a common motor.

In such a case the motor can have an appreciable power and it would be conceivable under certain particularly adverse conditions for potential customers to become pinched during opening.

According to a further advantageous embodiment of the invention, the effect thereof is limited in that the operating rod comprises a part which is joined to the projections and that part is resiliently connected to a part engaging on the motor means in such a way that if the force produced by the motor means exceeds a certain threshold said two parts move relative to one another, as a result of which the movement of the motor means is not transmitted, or is transmitted to a lesser extent, to the part joined to the projections.

BRIEF DESCRIPTION OF THE PREFERRED EMBODIMENTS

The invention will be explained in more detail below with reference to an illustrative embodiment shown in the drawing. In the drawing.

Figure 1:
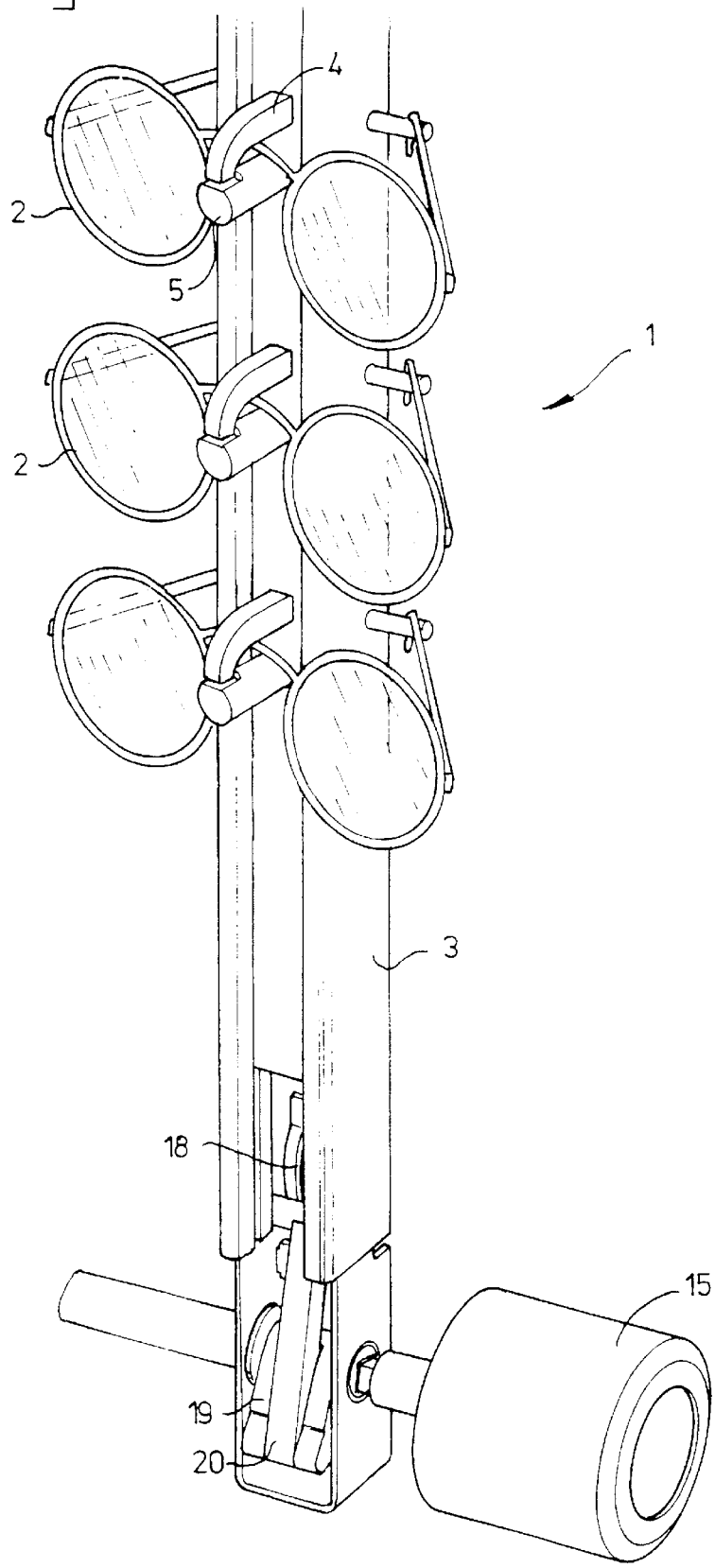
FIG. 1 shows a perspective view of a stand for spectacle frames and/or spectacles.

In FIG. 1 the device according to the invention is constructed as a display column 1. This display column serves to accommodate spectacle frames or spectacles 2. In the construction shown a single display column is shown. However, it must be understood that several such columns 1 can be arranged alongside one another.

Display column 1 consists of a support 3 provided with an electric drive motor 15 for driving the construction shown in FIGS. 2–5. In the case of a construction in which several display columns 1 are arranged alongside one another, the motor 15 can be common and the various parts of the various display columns can be operated by means of a rod connected thereto.

Figure 2:
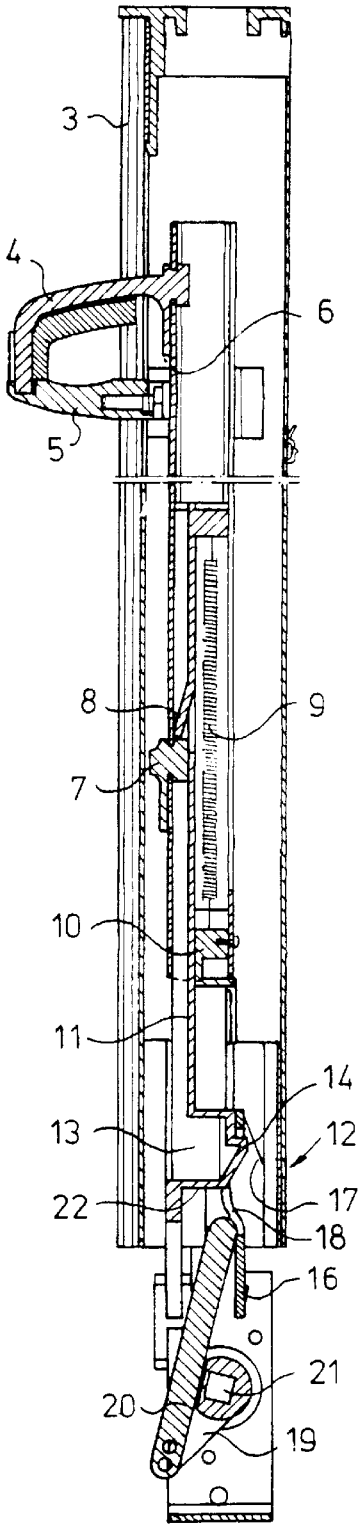
FIG. 2 shows a side view, in cross-section, of the device according to FIG. 1 in the closed position, that is to say the position in which the frames cannot be removed.

FIG. 2 shows a side view, in cross-section, of the device shown in FIG. 1, only the lowermost and uppermost parts being shown. It can be seen from this figure that a slide 6 is fitted inside the support 3, on which slide hook-shaped projections 4 have been positioned (only one is shown). The hook-shaped projections interact with stationary pin-shaped projections 5 which are rigidly mounted on the support 3. The projections 5 are optionally provided with recesses for receiving the hook-shaped projections 4.

Slide 6 is constructed as a C-section and at the bottom end is provided with a fixing part 10 to which a spring 9 is attached. At the other end, the spring 9 engages on a push rod 11. Said push rod 11 is provided with a stop lip 8 which in the normal position engages on a stop block 7 as can be seen in FIG. 2. In this position the spring 9 is under slight pretension. Push rod 11 is provided at the bottom end with a locking nose 14 which is provided with an abutment surface 22 at the bottom.

The motor means are not shown in FIG. 2. Only a crank 19 is shown, which crank is provided with a square opening 21 through which a correspondingly shaped rod connected to motor 15 can be fitted. A rod of this type can operate various display columns 1 according to the invention which are positioned alongside one another. Crank 19 is connected to connecting rod 20, the free end of which can be brought into engagement with contact surface 22.

A locking lip 16 is provided which is driven towards the locking nose 14 by the action of a leaf spring 17. The locking lip 16 is provided with an opening 18 into which the nose engages, as is shown in FIG. 2. In this way slide 6 is locked so that it cannot move upwards.

Figure 3:
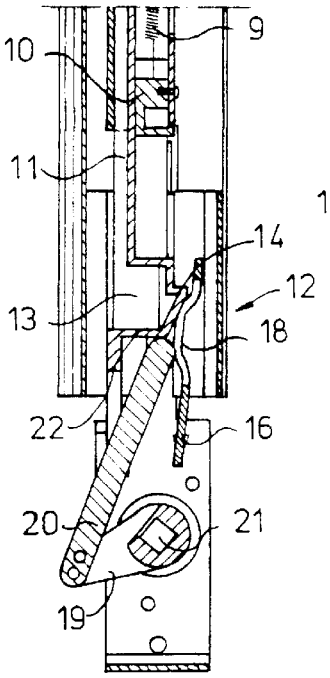
FIG. 3 shows part of the device according to FIG. 2 during opening.
Figure 4:
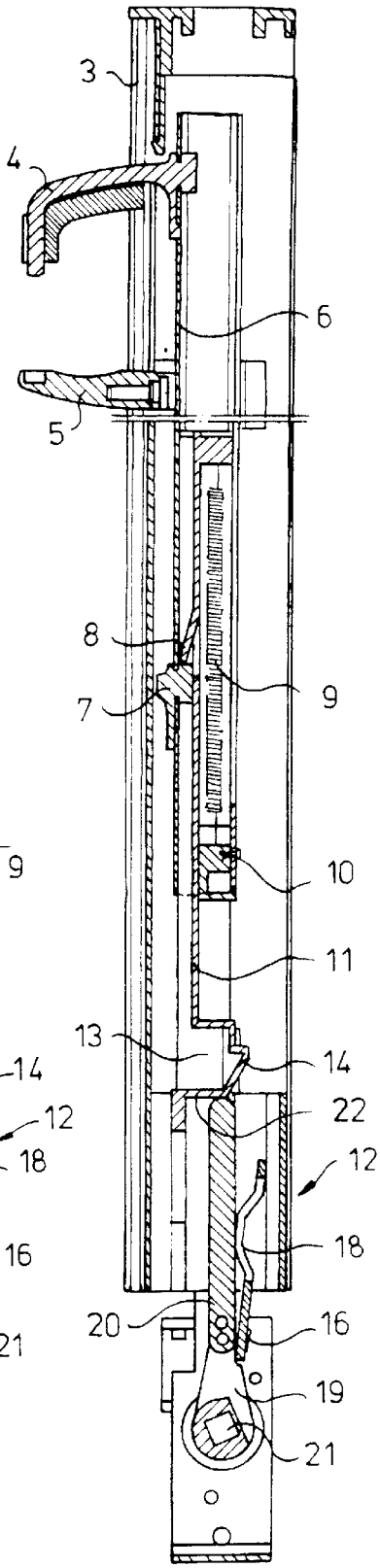
FIG. 4 shows the device according to FIG. 2 in the open position.
Figure 5:
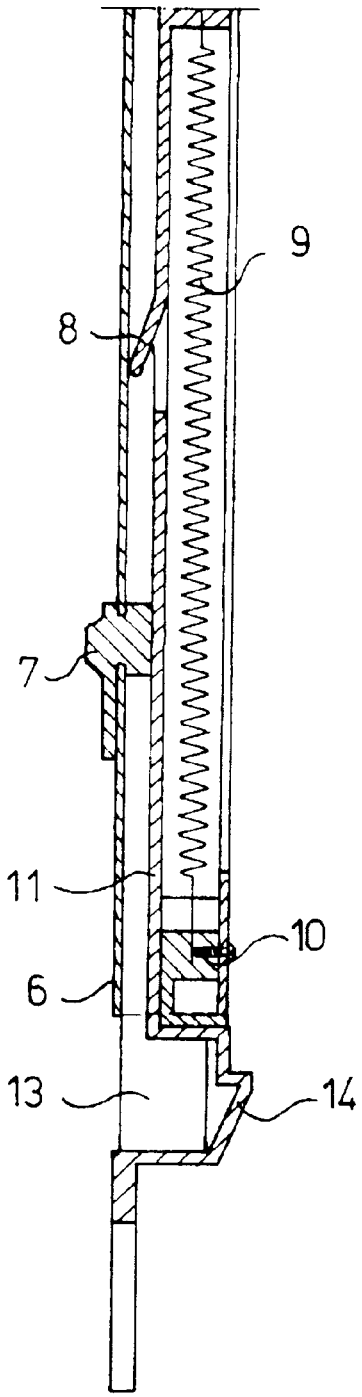
FIG. 5 shows a detail of the device according to FIGS. 2–4 in the situation in which an obstacle is encountered during opening.

Starting from the position shown in FIG. 2, motor 15 is operated and moves crank 19 upwards somewhat, as is shown in FIG. 3. As a result, connecting rod 20 moves upwards without, however, coming into engagement with surface 22. However, the free end of connecting rod 20 does drive locking lip 16 towards the right in the drawing, so that nose 14 is no longer located within opening 18 and the device is unlocked. On further movement of motor 15, connecting rod 20 moves upward as is shown in FIG. 4 into the terminal position in which projection 4 is located a distance away from projection 5 such that the article located between the two, such as a spectacle frame, can be removed.

If the motor is now moved back, no pull will be exerted on slide 6. If projection 4 is held in the up position, for example because there is something between the free end of projection 4 and projection 5, only the weight of slide 6 with the associated parts will press on projection 4. Because this weight is relatively low, this will not result in injury if parts of the body have been placed between projections 4 and 5. If projection 4 is then able to move towards projection 5, slide 6, together with push rod 11, will move downward under gravity and locking will take place. Slide 6 cannot be moved upwards after locking. After all, stop lip 8, which engages on stop block 7, and the locking of the nose 14 on locking lip 16 render projection 4 immovable. The downward movement can optionally be assisted by a spring.

With a construction of this type it is possible to use a relatively heavy duty motor for moving projections 4 away from projections 5. This is, in particular, important if a number of display columns are used alongside one another with a common drive motor.

Theoretically it is possible that during the opening movement by raising a projection 4 trapping can occur because of the projection 5 located above. To prevent this it is proposed to fit the spring 9 which acts between the slide 6, more particularly fixing part 10, and push rod 11. If projections 4 and 5 are held together when connecting rod 20 is moved upward the situation shown in FIG. 5 will arise in which the stop lip 8 moves away from the stop block 7 on further tensioning of the spring. In the rest position, spring 9 is so pretensioned that the protection feature just described becomes effective only when the force on the spring is greater than solely the mass of the guide including the associated parts and normal friction.

It will be understood that in addition to what is shown here, further protection systems are possible. For instance, sensors can be fitted which indicate when the projections 4 and 5 are in the closed, locked position.

Apart from greater safety, the device now shown has the advantage that said device is particularly simple to construct in modular form. After all, there is no longer a rigid fixing between connecting rod 20 and push rod 11. As a result the user can provide a number of display columns 1 positioned alongside one another starting from a base unit in which the drive motor 15 and various connecting rod mechanisms are positioned alongside one another, by simply clicking home supports 3. If one of such columns should develop a fault, the user can replace such a column simply him- or herself. Moreover, the transport costs can also be restricted in this way as a result of the packing volume, which has been reduced by at least 60%. As a result of the mechanism now chosen, tolerances in dimensions are less critical. After all, the stroke of the connecting rod mechanism can be chosen to be longer by an adequate margin to compensate for such tolerances. If a stop 8 is also fitted for the upward movement, any tolerance in the upward direction can be compensated for with the aid of the spring 9.

This construction also makes it possible to use a mixture of display columns of different stroke lengths.

It will be understood that operation of the drive motor can comprise any constructions known from the prior art, such as with the aid of remote control and the like. By way of example, reference is made to the abovementioned European Application EP-A 0 246 702.

Although the invention has been described above with reference to a preferred embodiment, it will be understood that numerous modifications can be made thereto without going beyond the scope of the present application in respect of which rights are requested in the appended claims.

What is claimed is:

1. Device (1) for the secure display of a number of articles (2) placed above one another, comprising; a support (3) provided with a number of first projections (5) rigidly attached thereto and an equal number of second projections (4) arranged such that they are movable with respect to said first projections, associated first and second projections defining, in a position in which they are brought together, retainers for accommodating said articles to be displayed, with the second projections arranged above the first projections, said movable second projections being connected to one another via an operating rod (6, 11) which is linked to motor means (15) in order to drive said second projections away from said first projections in order to release the retainers, wherein the movement of the operating rod is decoupled from the movement of the motor means when said first and second projections move towards one another if a predetermined force on said operating rod is exceeded to thereby prevent injury to users of the device.

2. Device according to claim 1, wherein said motor means are provided with a movable motor-driven striking element (20) arranged to come into contact with a contact surface of said operating rod (6, 11).

3. Device according to claim 1, wherein said locking means comprise a locking lip (16) which can be brought into engagement with said operating rod, which locking lip can be operated by said motor means.

4. Device according to claim 2, wherein said motor means comprise a crank (19)/connecting rod mechanism and the free end of the connecting rod can be brought into contact with a contact surface of said operating rod.

5. Device according to claim 3, wherein the free end of said connecting rod is able to engage on said locking lip.

6. Device according to claim 1, wherein said operating rod comprises a part which is joined to the second projections and which is connected in a resilient manner to a part engaging on the motor means such that if the force produced by the motor means exceeds a specific threshold said two parts move relative to one another, as a result of which the movement of the motor means is not transmitted, or is transmitted to a lesser extent, to the part joined to the second projections.

7. Assembly comprising a number of devices according to claim 1 arranged alongside one another, provided with common motor means.

8. Device according to claim 1, wherein locking means are provided for locking said first and second projections in the position in which they have been brought together.

* * * * *